US010520171B1

(12) United States Patent
Kotovsky

(10) Patent No.: US 10,520,171 B1
(45) Date of Patent: Dec. 31, 2019

(54) LIGHTING APPARATUS AND METHOD

(71) Applicant: Irwin Kotovsky, Pittsburgh, PA (US)

(72) Inventor: Irwin Kotovsky, Pittsburgh, PA (US)

(73) Assignee: Irwin Kotovsky, Pittsburgh, PA (US)

( * ) Notice: Subject to any disclaimer, the term of this patent is extended or adjusted under 35 U.S.C. 154(b) by 0 days.

(21) Appl. No.: 16/219,348

(22) Filed: Dec. 13, 2018

(51) Int. Cl.

| | |
|---|---|
| ***F21S 8/00*** | (2006.01) |
| ***F21V 21/02*** | (2006.01) |
| ***F21V 21/14*** | (2006.01) |
| ***F21V 23/00*** | (2015.01) |

(52) U.S. Cl.
CPC ..... *F21V 21/02* (2013.01); *F21V 21/14* (2013.01); *F21V 23/001* (2013.01)

(58) Field of Classification Search
CPC ..... F21V 21/02; F21V 23/001; F21V 21/41
See application file for complete search history.

(56) References Cited

U.S. PATENT DOCUMENTS 2,029,532 A * 2/1936 Karcher ..... F21V 21/26 403/114
2,458,967 A * 1/1949 Wiedenhoeft ..... F16C 11/10 248/283.1
5,599,091 A * 2/1997 Kira ..... F21V 21/30 362/269
2006/0227562 A1* 10/2006 Mast ..... F21S 6/001 362/392
2009/0040774 A1* 2/2009 Avila ..... F21V 21/28 362/371

* cited by examiner

*Primary Examiner* — Ali Alavi
(74) *Attorney, Agent, or Firm* — Ansel M. Schwartz

(57) ABSTRACT

A lighting apparatus for a ceiling or wall includes a mount having a hollow shaft whose top extends into the wall or ceiling when in place, and a flange that extends from the shaft adjacent the bottom of the shaft. The apparatus includes electrical leads connected to the top of the shaft disposed inside the wall or ceiling when the shaft extends into the wall or ceiling through which electricity passes. The apparatus includes a post that attaches to the shaft and through which electricity passes from the shaft. The apparatus includes an LED or a laser module that is connected to the post and receives electricity from the post to power the LED or the laser module. The LED or laser module swivels at least 45° relative to the post. The post structurally holding the LED or the laser module apart from the ceiling or wall. A method for lighting from a lighting apparatus attached to a wall or ceiling.

7 Claims, 4 Drawing Sheets

LIGHTING APPARATUS AND METHOD

FIELD OF THE INVENTION

The present invention pertains to a lighting apparatus which has a light source that extends from an object by a post that swivels in place without translation at least 45°. (As used herein, references to the "present invention" or "invention" relate to exemplary embodiments and not necessarily to every embodiment encompassed by the appended claims.) More specifically, the present invention pertains to a lighting apparatus which has a light source, which can be a laser or LED attached to an attachment piece extending from an enclosure attached to the post that extends from a wall or ceiling where the attachment piece swivels in place in the enclosure without translation at least 45°.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Artificial lighting is a necessary and common requirement in everyday life. In many instances, the artificial light is required to be attained in an unobtrusive and transparent manner, which dictates that the light source be as small and out of the way as possible. To this end, not only is the structure that holds the light source required to be as small as possible, but the light source itself needs to be able to be as small as possible, yet needs to be able to provide large amounts of light. The present invention is directed to a structure that holds the light source that is small and unobtrusive, where the light source, for its size provides large amounts of light in a specific direction.

BRIEF SUMMARY OF THE INVENTION

The present invention pertains to a lighting apparatus for a ceiling or wall. The apparatus comprises a mount having a hollow shaft whose top extends into the wall or ceiling when in place and a flange that extends from the shaft adjacent the bottom of the shaft. The flange attaches to an outside of the wall or ceiling and holds the shaft in the wall or ceiling. The apparatus comprises electrical leads connected to the top of the shaft disposed inside the wall or ceiling when the shaft extends into the wall or ceiling through which electricity passes. The apparatus comprises a post that attaches to the shaft and through which electricity passes from the shaft, the post in electrical communication with the leads to receive electricity from the leads. The post extending outward on the outside of the wall or ceiling. The apparatus comprises an LED or a laser module that is connected to the post and receives electricity from the post to power the LED or the laser module. The LED or laser module swivels at least 45° relative to the post. The post structurally holding the LED or the laser module apart from the ceiling or wall.

The present invention pertains to a method for lighting from a lighting apparatus attached to a wall or ceiling. The method comprises the steps of swiveling to a first position an LED or Laser module attached to a post at least 45° so light from the LED or the Laser module is directed to a first direction. The post is attached to a mount having a hollow shaft whose top extends into the wall or ceiling when in place and a flange that extends from the shaft adjacent the bottom of the shaft. The flange attaches to an outside of the wall or ceiling and holds the shaft in the wall or ceiling. Electrical leads are connected to the top of the shaft disposed inside the wall or ceiling when the shaft extends into the wall or ceiling through which electricity passes. The post attaches to the shaft and through which electricity passes from the shaft. The post in electrical communication with the leads to receive electricity from the leads. The post extending outward on the outside of the wall or ceiling. The LED or the laser module that is connected to the post and receives electricity from the post to power the LED or the laser module. The LED or laser module swivels at least 45° relative to the post. The post structurally holding the LED or the laser module apart from the ceiling or wall. There is the step of swiveling to a second position different than the first position the LED or the Laser module so the light from the LED or the Laser module is directed to a second direction different from the first direction.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
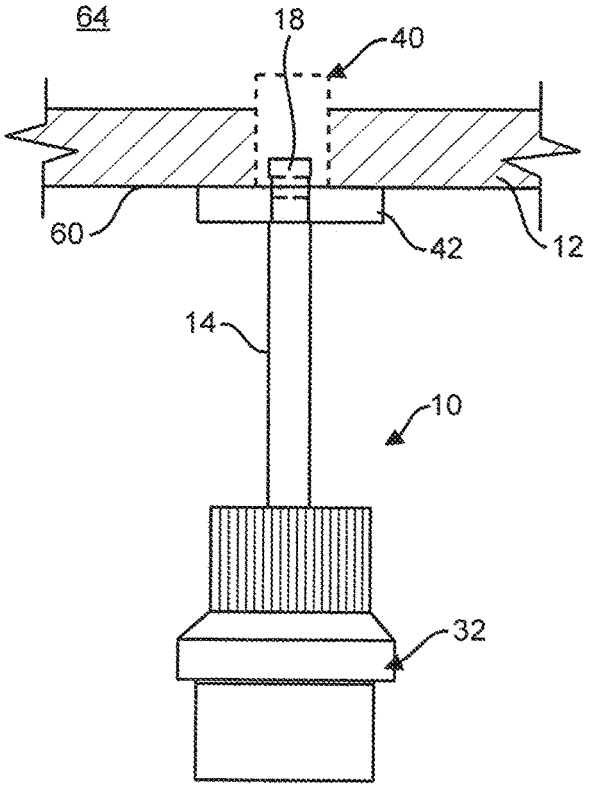
FIG. 1 is a front view of the apparatus of the present invention.

Referring now to the drawings wherein like reference numerals refer to similar or identical parts throughout the several views, and more specifically to FIGS. 1-4 thereof, there is shown a lighting apparatus 10 for a ceiling 12 or wall. The apparatus comprises a mount 50 having a hollow shaft 40 whose top 54 extends into the wall or ceiling 12 when in place and a flange 42 that extends from the shaft 40 adjacent the bottom 58 of the shaft 40. The flange 42 attaches to an outside 60 of the wall or ceiling 12 and holds the shaft 40 in the wall or ceiling 12. The apparatus comprises electrical leads 62 connected to the top of the shaft 40 disposed inside 64 of the wall or ceiling 12 when the shaft 40 extends into the wall or ceiling 12 through which electricity passes. The apparatus comprises a post 14 that attaches to the shaft 40 and through which electricity passes from the shaft 40, the post 14 is in electrical communication with the leads 62 to receive electricity from the leads 62. The post 14 extends outward on the outside 60 of the wall or ceiling 12. The apparatus comprises an LED or a laser module 32 that is connected to the post 14 and receives electricity from the post 14 to power the LED or the laser module 32. The LED or laser module 32 swivels at least 45° relative to the post 14. The post 14 structurally holding the LED or the laser module 32 apart from the ceiling 12 or wall.

The apparatus may include at least one screw 68 that extends through the flange 42 into the wall or ceiling 12 to attach the flange 42 to the wall or ceiling 12. The apparatus may include a cover plate 70 that fits over the flange 42 and covers the flange 42 and the screw 68. The apparatus may include electrical wires 72 that extend from the post 14 and connect with the LED or the laser module 32. The post 14 may have a first end 16, and a second end 18 that attaches to the mount 50; and may include an enclosure 20 that attaches to the post 14 in proximity to the first end 16 of the post 14. The enclosure 20 may have a ball joint 22, an opening 24 adjacent the ball joint 22, and an attachment piece 26 having a ball shaped end 28 and engages with the ball joint 22 and a stem 30 that extends from the ball shaped end 28 through the opening 24 of the enclosure 20 so the attachment piece 26 can swivel in place at least 45° without translation. The LED module 32 or the Laser module 32 attaches to the stem 30 at a second end of the stem 30. The LED or the Laser module 32 may move with the attachment piece 26 as the ball joint 22 and swivels in the enclosure 20. The ball joint 22 may include a concave portion 36 that fits with the ball shaped end 28 and a block portion 38 which is disposed in the enclosure 20.

The present invention pertains to a method for lighting from a lighting apparatus 10 attached to a wall or ceiling 12. The method comprises the steps of swiveling to a first position an LED or Laser module 32 attached to a post 14 at least 45° so light from the LED or the Laser module 32 is directed to a first direction. The post 14 is attached to a mount 50 having a hollow shaft 40 whose top 54 extends into the wall or ceiling 12 when in place and a flange 42 that extends from the shaft 40 adjacent the bottom 58 of the shaft 40. The flange 42 attaches to an outside 60 of the wall or ceiling 12 and holds the shaft 40 in the wall or ceiling 12. Electrical leads 62 are connected to the top of the shaft 40 disposed inside 64 of the wall or ceiling 12 when the shaft 40 extends into the wall or ceiling 12 through which electricity passes. The post 14 attaches to the shaft 40 and through which electricity passes from the shaft 40. The post 14 in electrical communication with the leads 62 to receive electricity from the leads 62. The post 14 extending outward on the outside 60 of the wall or ceiling 12. The LED or the laser module 32 that is connected to the post 14 and receives electricity from the post 14 to power the LED or the laser module 32. The LED or laser module 32 swivels at least 45° relative to the post 14. The post 14 structurally holding the LED or the laser module 32 apart from the ceiling 12 or wall. There is the step of swiveling to a second position different than the first position the LED or the Laser module 32 so the light from the LED or the Laser module 32 is directed to a second direction different from the first direction.

Figure 4:
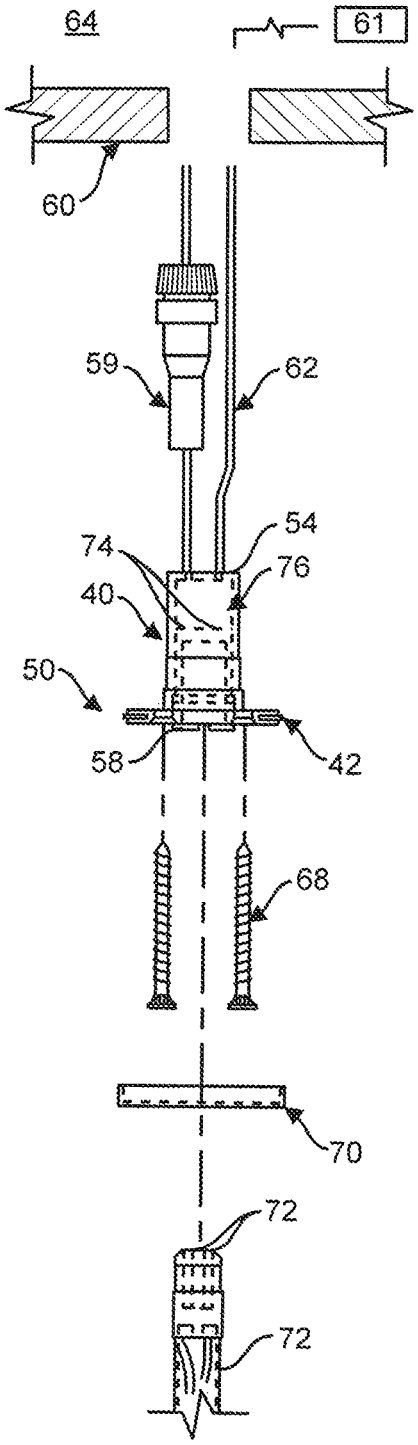
FIG. 4 is a side exploded view of the mount and plate.
Figure 5:
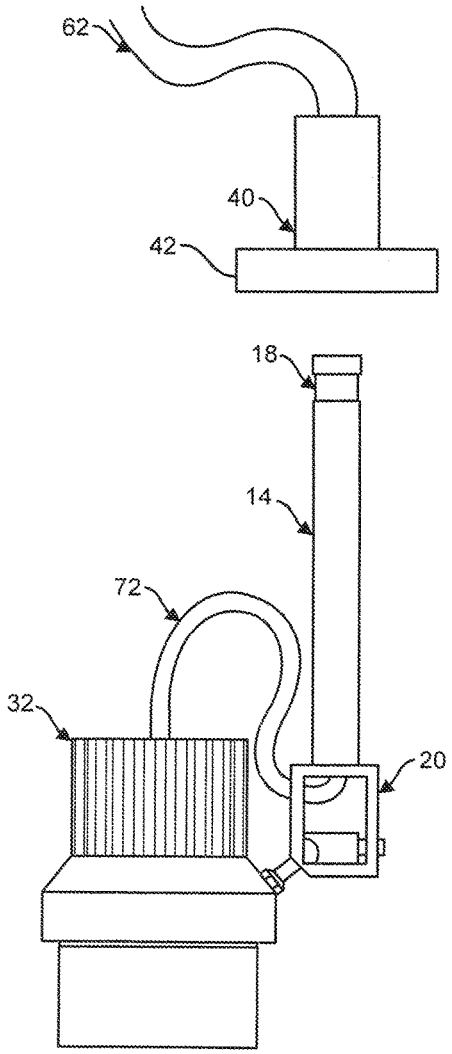
FIG. 5 is a side view of the apparatus.

In the operation of the invention, the lighting apparatus 10 is placed in the wall or the ceiling 12 by positioning a mount 50 in the wall or ceiling 12. The mount 50 has a hollow shaft 40 whose top 54 extends into a hole in the wall or ceiling 12 when in place. The mount 50 has a flange 42 that extends from the shaft 40 adjacent the bottom 58 of the shaft 40. The flange 42 attaches to the outside 60 of the wall or ceiling 12 and holds the shaft 40 in the wall or ceiling 12. There are two screws 68 that extend through the flange 42 into the wall or ceiling 12 to attach the flange 42 to the wall or ceiling 12, as shown in FIG. 4. A cover plate 70 fits over the flange 42 and covers the flange 42 and the screws 68.

There are electrical leads 62 connected to the top of the shaft 40 disposed inside 64 the wall or ceiling 12 when the shaft 40 extends into the wall or ceiling 12 through which electricity passes. One of the electrical leads 62 connects to a fuse holder 59 which holds a fuse, and another of the leads 62 connects to a remote transformer or junction box 61. The leads 62 are flexible.

A post 14 attaches to the shaft 40 and is preferably mechanically secured or locked in place to the post 14. The top of the post 14 has electrical contacts 74 which contact electrical contacts 74 on the inside 76 of the top of the shaft 40 when the post 14 is disposed inside the shaft 40. Electricity, from the electrical leads 62, passes from the shaft 40 to the post 14 through the electrical contacts 74. Through these electrical contacts 74, the post 14 is in electrical communication with the leads 62 to receive electricity from the leads 62. The post 14 extends outward on the outside 60 of the wall or ceiling 12. Electrical wires 72 connected to the electrical contacts 74 at the top of the post 14 extend through the hollow post 14 and out the bottom 58 of the post 14, which is open.

An LED or a laser module 32 is connected to the post 14 and receives electricity from the electrical wires 72 that extend out from the bottom 58 of the post 14 to power the LED or the laser module 32. The LED or laser module 32 swivels at least 45° relative to the post 14. The post 14 structurally holds the LED or the laser module 32 apart from the ceiling 12 or wall.

The post 14 is a hollow metal or plastic bar. The second end 16 of the post 14 is fixed to the top of an enclosure 20. The enclosure 20 is a metal or plastic box which is hollow. Fixed to the bottom 58 of the enclosure 20 is a block portion 38 with a concave portion 36 adjacent an opening 24 at a bottom 58 corner of the enclosure 20.

A ball shaped end 28 of an attachment piece 26 fits into the concave portion 36 in the enclosure 20. The ball shaped end 28 is able to rotate in place in the enclosure 20 between the bottom 58 corner of the enclosure 20 where the attachment piece 26 extends through the opening 24 and the concave portion 36 but is prevented from moving in translation, so there is no wiggle or looseness to the attachment piece 26. This structural forms real constraints on the ball shaped end 28 of the attachment piece 26 and creates a ball joint 22 between the attachment piece 26 and the enclosure 20.

Figure 2:
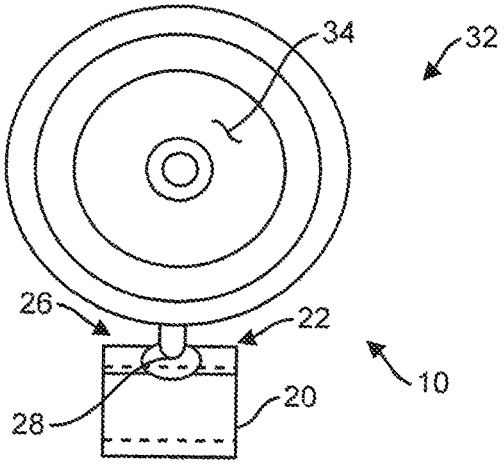
FIG. 2 is a side view of the apparatus.
Figure 3:
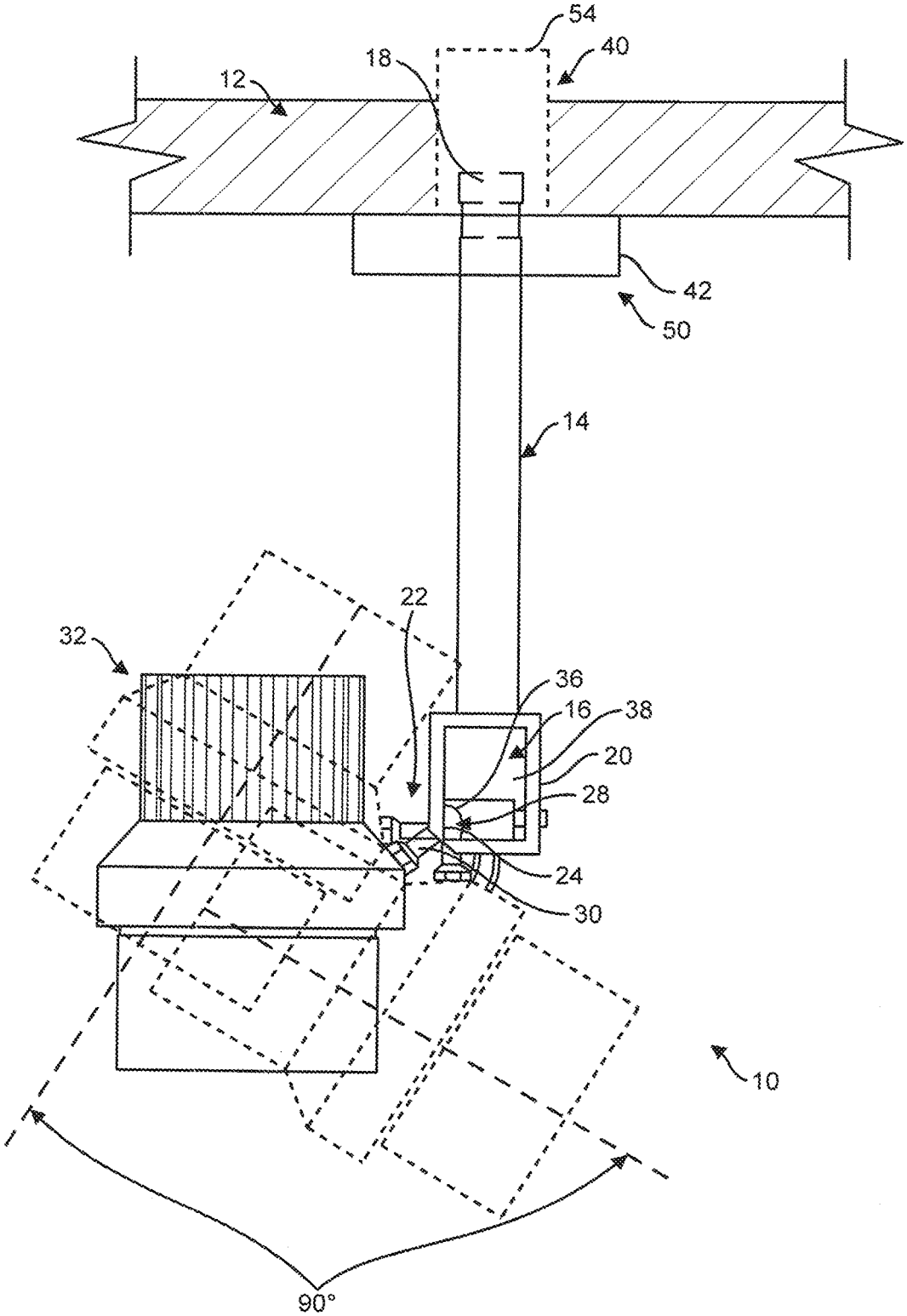
FIG. 3 is a bottom view of the apparatus.

The attachment piece 26 has a stem 30 that extends from the ball shaped end 28 and attaches to a light module 32, either by being screwed into the light module 32 or welded or brazed or adhered with adhesive to the light module 32. The light module 32 has a light source 34 which is either an LED or a laser. The light module 32 is able to rotate up to about 90° relative to the enclosure 20 by the ball joint 22 swiveling in the enclosure 20 without linear movement or translation, as shown in FIG. 2. Besides being able to swivel, the stem 30 of the attachment piece 26 is also able to rotate up to 360° in a plane perpendicular to the plane of the stem 30 central axis. This provides for movement of the light module 32 essentially in two dimensions, but not linearly up and down or linearly side to side. The ball shaped end 28 of the attachment piece 26 is held securely enough in the concave portion 36 that wherever the light module 32 is moved to relative to the enclosure 20, the light module 32 is maintained at that position and will not slip by movement of the ball joint 22. It should be noted that if it is desired to move the light module 32 literally up and down, relative to the wall or ceiling 12, the post 14 can be made up of a fixed part and a telescoping part relative to the fixed part that can be fixed in relative length by an overlapping threaded portion the threads down on the fixed part and the telescoping part when the desired length is reached.

Figure 6:
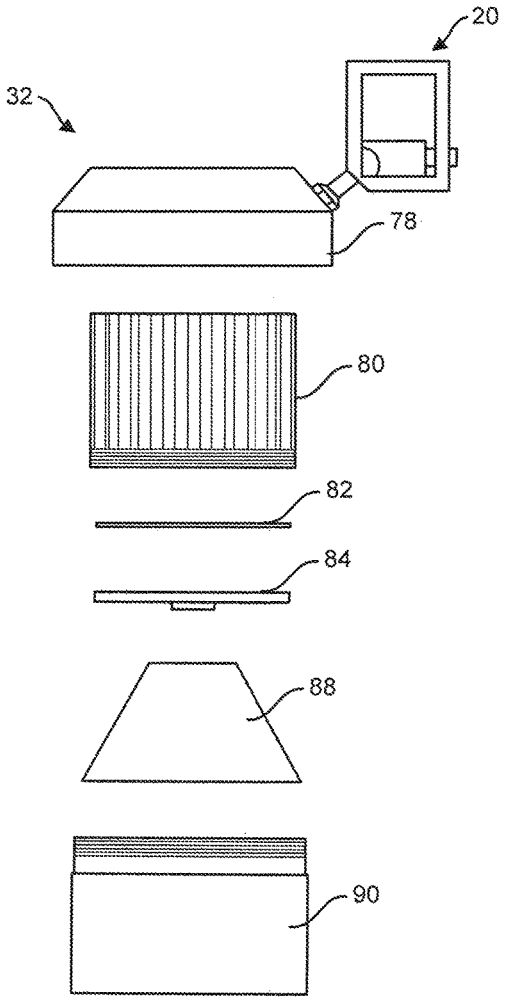
FIG. 6 is an exploded view of the module.

Referring to FIG. 6, an exploded view of the module is shown. The module is comprised of a module ring 78 connected to the stem that extends from the enclosure. The heat sink 80 fits through and extends up from the module ring 78. A thermal pad 82 attaches to the bottom 58 of the heat sink 80 to facilitate the flow of heat to the heat sink 80 from the LED board 84 attached to the bottom 58 of the thermal pad 82. The LED board 84 has the LED and the Inrush current limiter 86. If a laser is used instead of the LED, the laser is mounted to the circuit board 84. The LED optic 88 is positioned over the LED and held in place by the optic 88 holder 90 which screws into the bottom 58 of the module ring 78. The thermal pad 82 and the circuit board 84 are held in position when the holder 90 is screwed into the ring 78. If a laser is used instead of the LED, the laser is positioned where the LED would be positioned.

The circuit board 84 screws into the heat sink 80. The thermal pad 82 is held in place when the circuit board 84 is screwed into the heat sink 80. The LED optic 88 is attached to the board 84 either by being screwed or snapping into place on the board 84. The optic 88 housing fits over the sinkpadboardLED optic 88 assembly and screws into the ring 78, thus holding the sinkpadboardLED optic 88 assembly in place.

A Current Inrush Limiter is part of the LED board 84 in the LED Module. If a laser is used, the Current Inrush Limiter is part of the Laser board 84 in the Laser module 32. Inrush current limiters (thermistors) are among the most common design options used in switching power supplies to prevent damage caused by inrush current surges. A thermistor is a thermally-sensitive resistor with a resistance that changes significantly and predictably as a result of temperature change. As the inrush current limiter 86 self-heats, the current begins to flow through it. Its resistance begins to drop and a relatively small current flow charges the capacitors in the power supply. After the capacitors in the power supply become charged, the self-heated inrush current limiter 86 offers little resistance in the circuit. Inrush current limiters are available from 0.2 to 220 ohms of initial resistance. Some are rated for less than one ampere while others are rated for up to 36 amperes. The LED module 32 is preferably a 2.5 w/500 mA LED module.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A lighting apparatus for a ceiling or wall comprising:

a mount having a hollow shaft whose top extends into the wall or ceiling when in place, and a flange that extends from the shaft adjacent the bottom of the shaft, the flange attaches to an outside of the wall or ceiling and holds the shaft in the wall or ceiling;

electrical leads connected to the top of the shaft disposed inside the wall or ceiling when the shaft extends into the wall or ceiling through which electricity passes;

a post that attaches to the shaft and through which electricity passes from the shaft, the post in electrical communication with the leads to receive electricity from the leads, the post extending outward on the outside of the wall or ceiling; and an LED or a laser module that is connected to the post and receives electricity from the post to power the LED or the laser module, the LED or laser module swivels at least 45° relative to the post, the post structurally holding the LED or the laser module apart from the ceiling or wall.

2. The apparatus of claim 1 including at least one screw that extends through the flange into the wall or ceiling to attach the flange to the wall or ceiling.

3. The apparatus of claim 2 including a cover plate that fits over the flange and covers the flange and the screw.

4. The apparatus of claim 3 including electrical wires that extend from the post and connect with the LED or the laser module.

5. The apparatus of claim 4 wherein the post has a first end and a second end that attaches to the mount; and including an enclosure that attaches to the post in proximity to the first end of the post, the enclosure having a ball joint, an opening adjacent the ball joint, and an attachment piece having a ball shaped end and engages with the ball joint and a stem that extends from the ball shaped end through the opening of the enclosure so the attachment piece can swivel in place at least 45° without translation, the LED or the Laser module stem attaches to the stem at a second end of the stem, the LED or the Laser module moves with the attachment piece as the ball joint and swivels in the enclosure.

6. The apparatus of claim 5 wherein the ball joint includes a concave portion that fits with the ball shaped end and a block portion which is disposed in the enclosure.

7. A method for lighting from a lighting apparatus attached to a wall or ceiling comprising the steps of:

swiveling to a first position an LED or Laser module attached to a post at least 45° so light from the LED or the Laser module is directed to a first direction, the post attached to a mount having a hollow shaft whose top extends into the wall or ceiling when in place, and a flange that extends from the shaft adjacent the bottom of the shaft, the flange attaches to an outside of the wall or ceiling and holds the shaft in the wall or ceiling; electrical leads connected to the top of the shaft disposed inside the wall or ceiling when the shaft extends into the wall or ceiling through which electricity passes; the post attaches to the shaft and through which electricity passes from the shaft, the post in electrical communication with the leads to receive electricity from the leads, the post extending outward on the outside of the wall or ceiling; the LED or the laser module that is connected to the post and receives electricity from the post to power the LED or the laser module, the LED or laser module swivels at least 45° relative to the post, the post structurally holding the LED or the laser module apart from the ceiling or wall; and swiveling to a second position different than the first position the LED or the Laser module so the light from the LED or the Laser module is directed to a second direction different from the first direction.

* * * * *